US010900670B2

(12) United States Patent
Wang et al.

(10) Patent No.: US 10,900,670 B2
(45) Date of Patent: Jan. 26, 2021

(54) AIR CONDITIONER INDOOR UNIT AND AIR CONDITIONER

(71) Applicants: MIDEA GROUP CO., LTD., Foshan (CN); GD MIDEA AIR-CONDITIONING EQUIPMENT CO., LTD., Foshan (CN)

(72) Inventors: Xiansong Wang, Foshan (CN); Qiang Qin, Foshan (CN); Xinchang Chen, Foshan (CN)

(73) Assignees: MIDEA GROUP CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 0 days.

(21) Appl. No.: 16/706,185

(22) Filed: Dec. 6, 2019

(65) Prior Publication Data

US 2020/0109864 A1 Apr. 9, 2020

Related U.S. Application Data

(63) Continuation of application No. PCT/CN2017/094101, filed on Jul. 24, 2017.

(30) Foreign Application Priority Data

Jun. 6, 2017 (CN) ..... 2017 2 0653734 U

(51) Int. Cl.
*F24F 1/0007* (2019.01)

(52) U.S. Cl.
CPC ..... *F24F 1/0007* (2013.01)

(58) Field of Classification Search
CPC ..... F24F 1/0007; F24F 13/20; F24F 13/082
See application file for complete search history.

(56) References Cited

U.S. PATENT DOCUMENTS

2015/0300678 A1* 10/2015 Niimura ..... F24F 13/20 454/284
2016/0345454 A1* 11/2016 Cheng ..... H05K 5/0217
2017/0138613 A1 5/2017 Bai et al.

FOREIGN PATENT DOCUMENTS

CN 104748238 A 7/2015
CN 205909482 U 1/2017
(Continued)

OTHER PUBLICATIONS

World Intellectual Property Organization (WIPO) International Search Report for PCT/CN2017/094101 dated Mar. 6, 2018 6 Pages.
(Continued)

*Primary Examiner* — Emmanuel E Duke
(74) *Attorney, Agent, or Firm* — Anova Law Group PLLC

(57) ABSTRACT

An air conditioner indoor unit includes a chassis and a face frame. The chassis extends along an up-down direction and includes a plurality of fastening structures arranged at upper end of the chassis and spaced along a left-right direction. The face frame includes an upper support, a lower frame, and two side connectors opposite to each other and connected between the upper support and the lower frame. The upper support includes a fastening member arranged at a rear end of the upper support. The fastening member is detachably fastened to the upper end of the chassis. The lower frame is detachably connected to a lower end of the chassis.

14 Claims, 15 Drawing Sheets

(56) References Cited

FOREIGN PATENT DOCUMENTS

| | | | |
|---|---|---|---|
| EP | 2937642 | A1 | 10/2015 |
| JP | 2001194002 | A | 7/2001 |

OTHER PUBLICATIONS

The European Patent Office (EPO) Extended Search Report for EP Application No. 17912721.2 dated May 25, 2020 11 Pages.
World Intellectual Property Organization (WIPO) Written Opinion for PCT/CN2017/094101 dated Mar. 6, 2018 7 Pages.

* cited by examiner

AIR CONDITIONER INDOOR UNIT AND AIR CONDITIONER

CROSS-REFERENCE TO RELATED APPLICATIONS

This application is a continuation of International Application No. PCT/CN2017/094101, filed Jul. 24, 2017, which claims priority to Chinese Application No. 201720653734.9, filed Jun. 6, 2017, the entire contents of both of which are incorporated herein by reference.

TECHNICAL FIELD

The present disclosure relates to the technical field of air conditioners, and in particular, to an air conditioner indoor unit and an air conditioner.

BACKGROUND

Nowadays, as the air conditioners are becoming increasingly popular, and users focus more on the health issues caused by the uses of air conditioners. When the air conditioner works, the indoor air is blown back to the room after passing through a filter, an evaporator, an impeller, and an air passage in this order. If failing to be cleaned in time or thoroughly, the above parts will be easily accumulated with dust, eroded by condensed water and water vapor, which is prone to breed bacteria and even mildew, such that the cold air from the air conditioner will also be polluted. However, the existing air conditioner indoor units are usually assembled along an up-down direction. In detail, a chassis (a part of the air passage is provided at the chassis), a motor impeller, an evaporator, a face frame, a filter, and a panel are assembled in sequence. As a result, the panel and the filter can be disassembled easily, and only the filter can be taken out by user for clean. Due to complicate assembly relationships among the other parts, user cannot take them out for clean. Such that the indoor units are likely to bring risks to human health.

SUMMARY

The main objective of the present disclosure is to provide an air conditioner indoor unit, aiming at improving the convenience of disassembly and assembly of the indoor unit and facilitating deep cleaning of the indoor unit.

In order to achieve the above objective, the present disclosure provides an air conditioner indoor unit, including a chassis, a face frame, a panel, a heater exchanger and an air outlet frame. The chassis extends along an up-down direction, and an upper end of the chassis is provided with a plurality of fastening structures spaced along a left-right direction. The face frame includes an upper support, a lower frame detachably connected to a lower end of the chassis, and two side connectors opposite to each other and between the upper support and the lower frame. A fastening member is arranged at a rear end of the upper support and detachably fastened to the upper end of the chassis.

Optionally, a distance between one of the plurality of fastening structures and a top surface of the upper support is greater than a distance between another one of the plurality of fastening structures and the top surface of the upper support.

Optionally, the fastening structure includes a fastening hole formed at a front wall surface of the upper end of the chassis. The fastening fit member includes an elastic arm protruding downwards from a bottom surface of the rear end of the upper support and extending backwards, and a convex clasp provided at an upper side surface of a free end of the elastic arm, and the clasp being located at a side of a rear wall surface of the upper end of the chassis when the face frame being in an assembled state. When the face frame is in the assembled state, the fastening member is fastened with the fastening structure to limit the face frame in a front-rear direction; and when a lower end of the face frame is rotated to a preset angle with respect to the upper end of the chassis, the fastening member is disengaged from the fastening structure.

Optionally, an avoidance recess is provided above a front side of the fastening hole for the elastic arm to escape, and when the face frame is in the assembled state, an avoidance gap is formed between a lower side surface of the elastic arm and a lower wall surface of the fastening hole for the elastic arm to escape.

Optionally, a limiting protrusion is provided at a portion of a top surface of the chassis corresponding to the fastening structure, and the fastening member is provided with a limiting hole configured to receive the limiting protrusion.

Optionally, the fastening structure includes a fastening hole formed at a front wall surface of the upper end of the chassis. The fastening member includes an elastic arm protruding downwards from a bottom surface of the rear end of the upper support and extending backwards.

The elastic arm includes a connection section connected with the upper support and defining the limiting hole, a support section extending downwards from a front end of the connection section, and an insertion section extending backwards from a lower end of the support section, and inserted into the fastening hole when the face frame is in an assembled state. The connection section, the support section and the insertion section are connected with each other in sequence.

Optionally, an entrance portion of a front end of the fastening hole comprises a guiding bevel inclined upwards and forwards.

Optionally, the air conditioner indoor unit further includes a fastener. A plurality of through holes are formed at a front side of the lower frame and spaced along a left-right direction. A plurality of fixing holes are formed at the lower end of the chassis and corresponding to the through holes. The fastener passes through the through hole and the fixing hole to fix the face frame and the chassis; or the lower frame is detachably fastened to the lower end of the chassis.

Optionally, the panel includes an upper panel and a lower panel cooperated with the upper panel to cover a front side of the face frame. The upper end of the upper panel is pivotally connected to a front end of the upper support, and a lower end of the upper panel is rotatable with respect to the upper support to open the indoor unit. The lower end of the lower panel is pivotally connected to the lower end of the chassis, and an upper end of the lower panel is rotatable with respect to the chassis to open the indoor unit.

The present disclosure further provides an air conditioner, including an indoor unit. The air conditioner indoor unit includes a chassis, a face frame, a panel, a heater exchanger and an air outlet frame. The chassis extends along an up-down direction, and an upper end of the chassis is provided with a plurality of fastening structures spaced along a left-right direction. The face frame includes an upper support, a lower frame detachably connected to a lower end of the chassis, and two side connectors opposite to each other and between the upper support and the lower frame. A fastening member is arranged at a rear end of the upper support and detachably fastened to the upper end of the chassis.

In the technical solutions of the present disclosure, if the air conditioner indoor unit needs to be deeply cleaned, related parts should be disassembled, and the disassembly process includes: first, the panel is rotated to expose the front side of the air outlet frame; then, after the lower frame is disconnected from the lower end of the chassis, the lower end of the face frame is rotated to a preset angle with respect to the upper end of the chassis, so that the fastening member can be disengaged from the fastening structure, for easily removing the face frame. After the face frame is removed, the heat exchanger of the air conditioner indoor unit can be fully exposed, which is conducive to thoroughly clean the heat exchanger, and deeply clean relevant components such as the air passage, the air outlet frame and the impeller. In addition, since components such as the panel and the face frame can be easily disassembled, the convenience of maintaining the air conditioner indoor unit is also increased.

BRIEF DESCRIPTION OF THE DRAWINGS

In order to more clearly illustrate the embodiments of the present disclosure, the drawings used in the embodiments will be briefly described below. Obviously, the drawings in the following description are only some embodiments of the present disclosure. It will be apparent to those skilled in the art that other figures can be obtained from the structures illustrated in the drawings without the inventive effort.

DESCRIPTION OF REFERENCE NUMERALS

Figure 1:
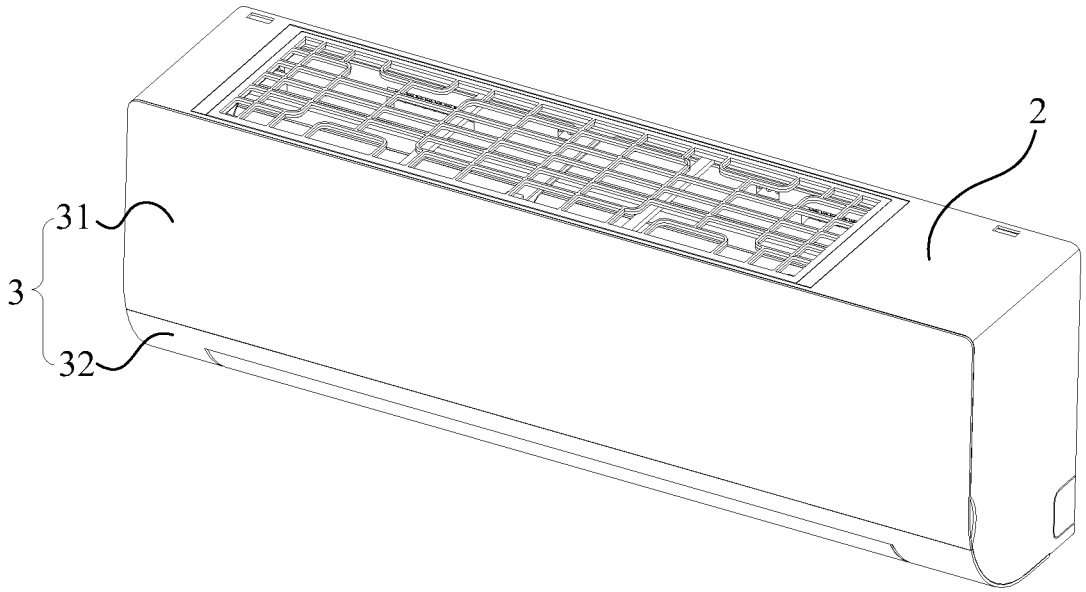
FIG. 1 is a schematic structural view of an air conditioner indoor unit in an assembled state according to an embodiment of the present disclosure.

| Label | Name | Label | Name |
|---|---|---|---|
| 1 | Chassis | 11 | Fastening hole |
| 12 | Avoidance recess | 16 | Elastic clasp piece |
| 14 | Limiting protrusion | 15 | Guiding bevel |
| 2 | Face frame | 21 | Upper support |
| 211 | Elastic arm | 211a | Clasp |
| 211b | Limiting hole | 211c | Connection section |
| 211d | Support section | 211e | Insertion section |

-continued

| Label | Name | Label | Name |
|---|---|---|---|
| 22 | Lower frame | 221 | Through hole |
| 23 | Side connector | 24 | Filter mounting frame |
| 3 | Panel | 31 | Upper panel |
| 32 | Lower panel | 4 | Heater exchanger |
| 5 | Air outlet frame | 6 | Impeller |
| 7 | Motor | 13 | Rib |
| 17 | Fixing hole | 222 | Fastener |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be described in the following with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It is to be understood that, all of the directional instructions in the embodiments of the present disclosure (such as up, down, left, right, front, rear . . . ) are used for explaining relative position relations, moving conditions of the elements in a particular attitude (as shown in the figures), and so on. If the particular attitude changes, the directional instructions change accordingly.

In addition, terms like "first" and "second" in the embodiments of present disclosure are used for descriptive purposes, and should not be understood as indicating or suggesting relative importance or implicating the number of the associated technical character. Therefore, the character indicated by "first" the "second" can explicitly or implicitly include at least one of such character. Besides, the technical solutions of different embodiments can be combined with each other, as long as they do not conflict with each other.

The present disclosure provides an air conditioner indoor unit.

Referring to FIG. 1 to FIG. 9, according to an embodiment of the present disclosure, the air conditioner indoor unit is a wall-mount air conditioner indoor unit, including a chassis 1, a face frame 2, a panel 3, a heat exchanger 4, and an air outlet frame 5. The chassis 1 extends along an up-down direction, and an upper end of the chassis 1 is provided with a plurality of fastening structures spaced along a left-right direction. The face frame 2 includes an upper support 21 (or simply "support"), a lower frame 22 (also referred to as an "end frame"), and two side connectors 23 opposite to each other and between the upper support 21 and the lower frame 22. A rear end of the upper support 21 is provided with a fastening member that is detachably fastened to the upper end of the chassis 1, and the lower frame 22 is detachably connected to a lower end of the chassis 1.

The face frame 2 also includes a filter mounting frame 24 provided between the upper support 21 and the lower frame 22, and generally, the top surface of the upper support 21 includes an air inlet. The filter of the air conditioner indoor unit is installed on and covers the filter mounting frame 24 so as to filter the air entering the heat exchanger 4 through the air inlet. Besides, in the present embodiment, the left and right ends of the chassis 1 are both provided with oblique downward guiding rails (not shown), and the left and right ends of the air outlet frame 5 are both provided with guiding sliders (not shown) that can be slidably matched with the guiding rails. After the panel 3 is opened, the air passage assembly (usually including components such as an air outlet frame 5, an impeller 6, a motor 7, an air deflector, a louver, a bearing seat, a pressure plate for the motor 7, etc.) can be taken out from between the chassis 1, the face frame 2 and the evaporator along the guide rails, and the air passage connected to the air outlet frame 5 is exposed, such that such that deep cleaning can be performed on the air passage, the air outlet frame 5 and the impeller 6, etc.

In the present disclosure, if the air conditioner indoor unit needs to be deeply cleaned, related parts need to be disassembled, and the disassembly process includes: first, the panel 3 is rotated to expose the front side of the air outlet frame 5; then the air outlet frame 5 and the impeller 6 and the motor 7 fixedly connected to the air outlet frame 5 are integrally slid out from the chassis 1 to expose the connection between the lower frame 22 and the lower end of the chassis 1; then, after the lower frame 22 is disconnected from the lower end of the chassis 1, the lower end of the face frame 2 is rotated to a preset angle with respect to the upper end of the chassis 1, so that the fastening member can be disengaged from the fastening structure, for easily removing the face frame 2. After the face frame 2 is removed, the heat exchanger 4 of the air conditioner indoor unit can be fully exposed, and hence can be thoroughly cleaned, and relevant components such as the air passage, the air outlet frame 5 and the impeller 6 can also be deeply cleaned. In addition, since components such as the panel 3, the air outlet frame 5 and the face frame 2 can be easily disassembled, the convenience of maintaining the air conditioner indoor unit is also increased.

Figure 2:
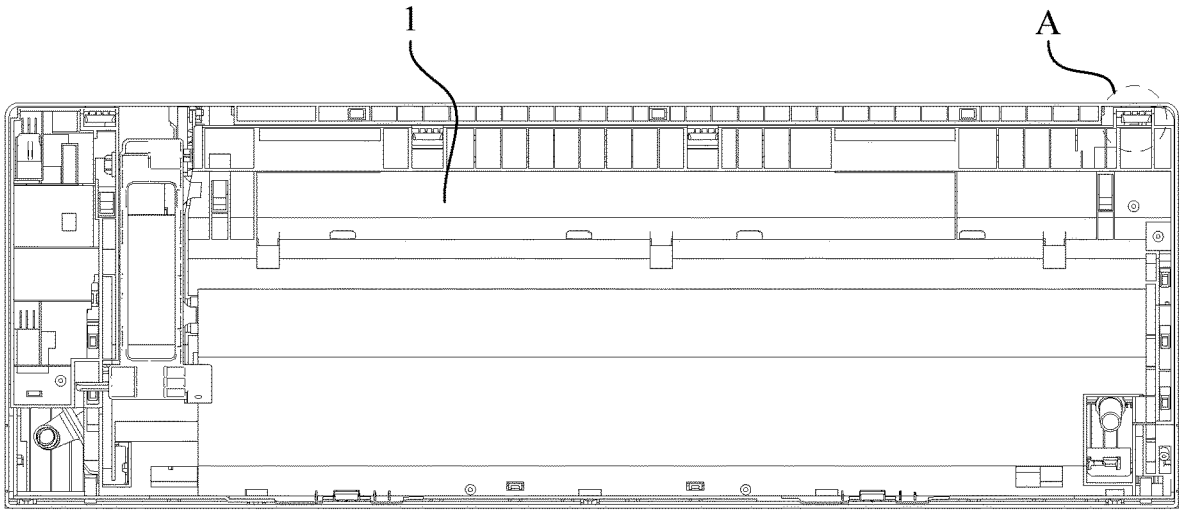
FIG. 2 is a rear view of the air conditioner indoor unit in the assembled state in FIG. 1.
Figure 3:
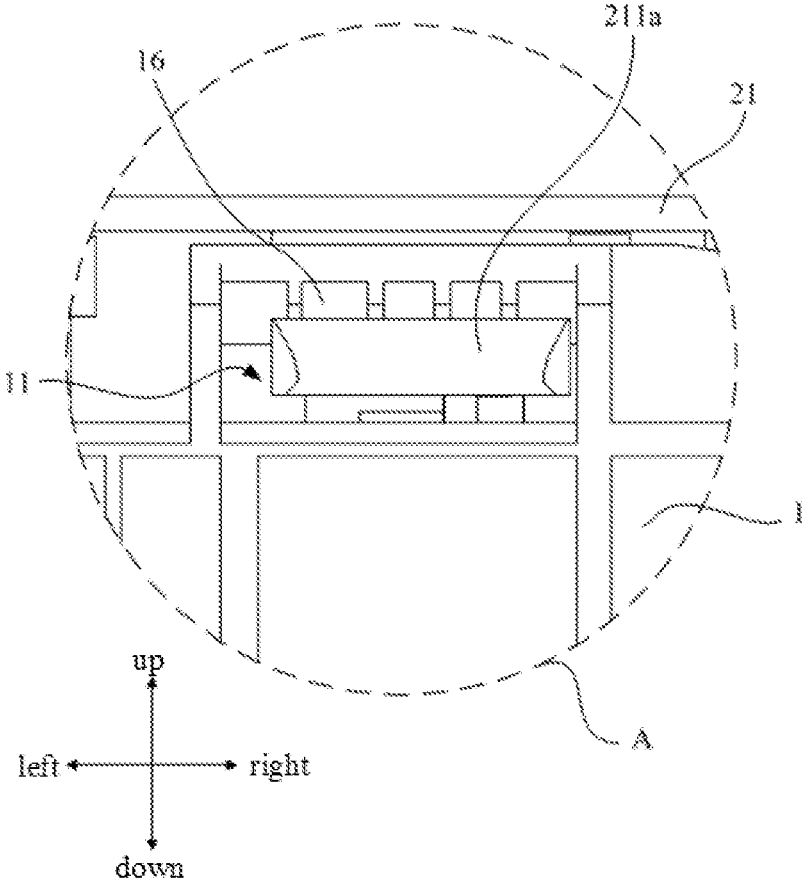
FIG. 3 is an enlarged view of portion A in FIG. 2.
Figure 4:
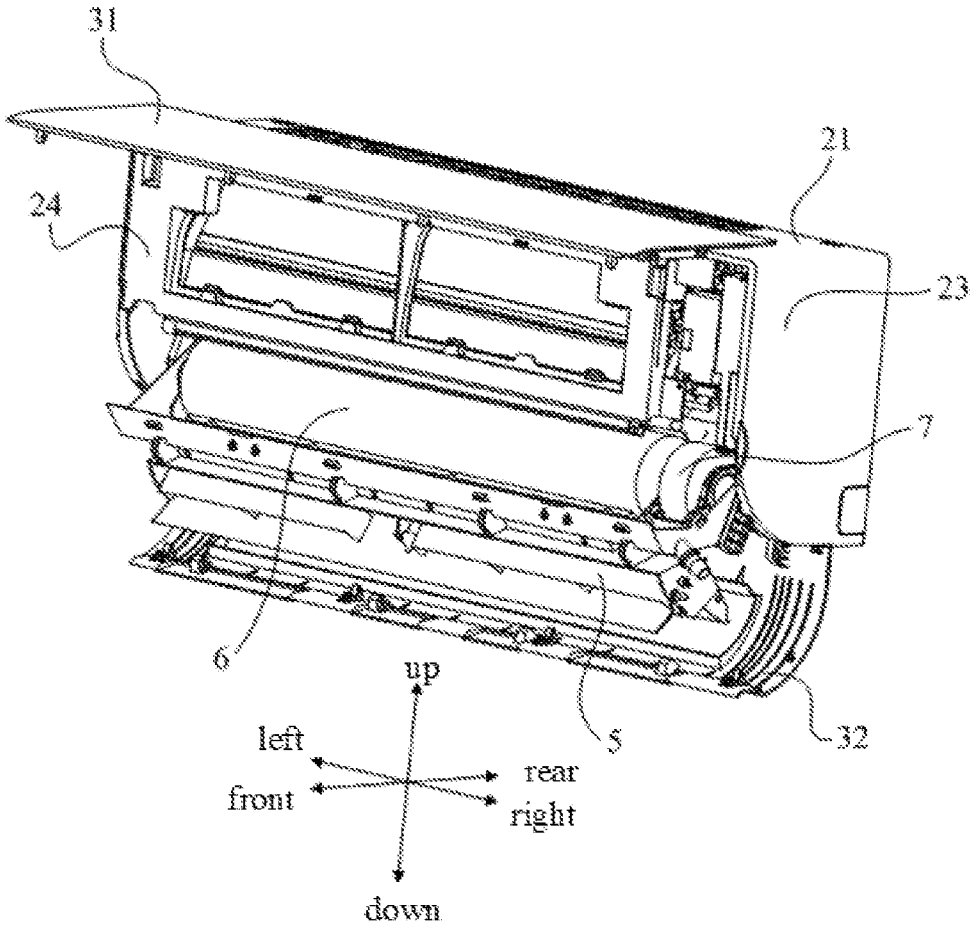
FIG. 4 is a schematic structural view of the air conditioner indoor unit when a panel in FIG. 1 is in an open state.
Figure 5A:
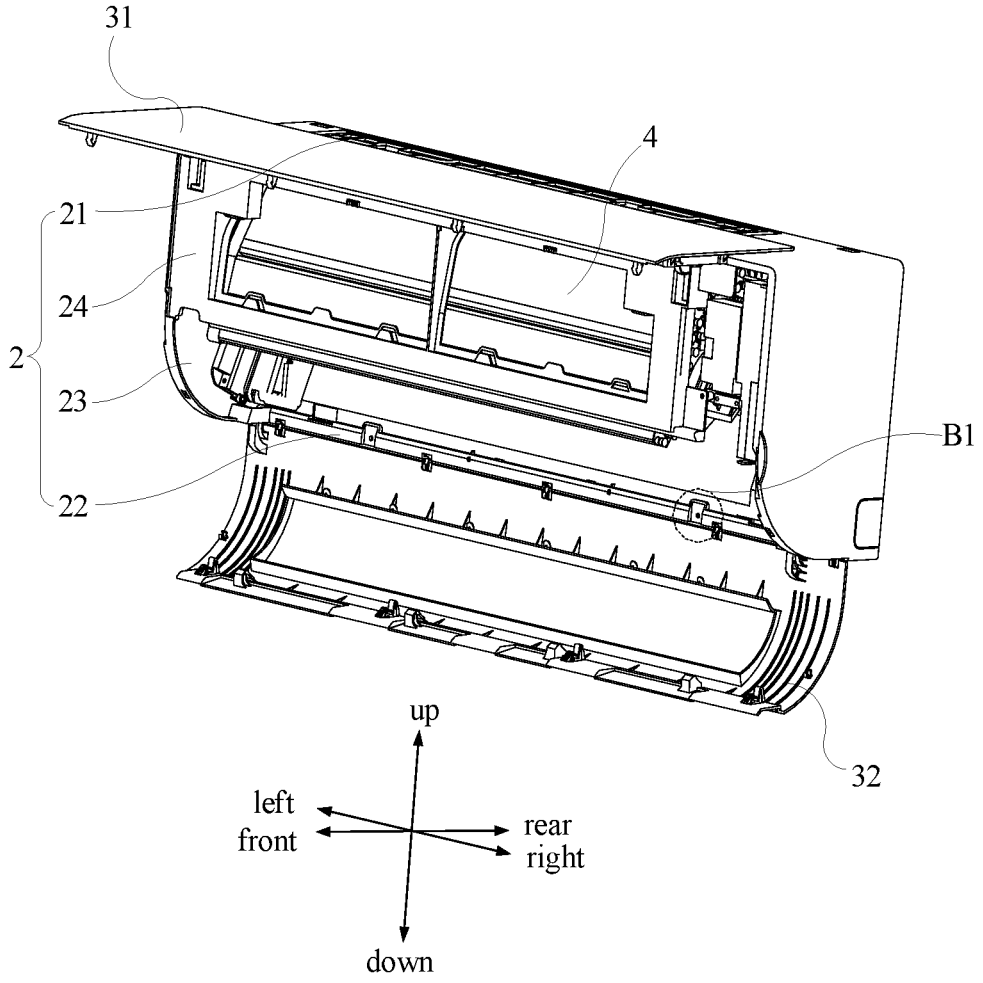
FIGS. 5A, 5B, and 5C are schematic structural views of the air conditioner indoor unit when the air outlet assembly in FIG. 4 is removed.
Figure 5B:
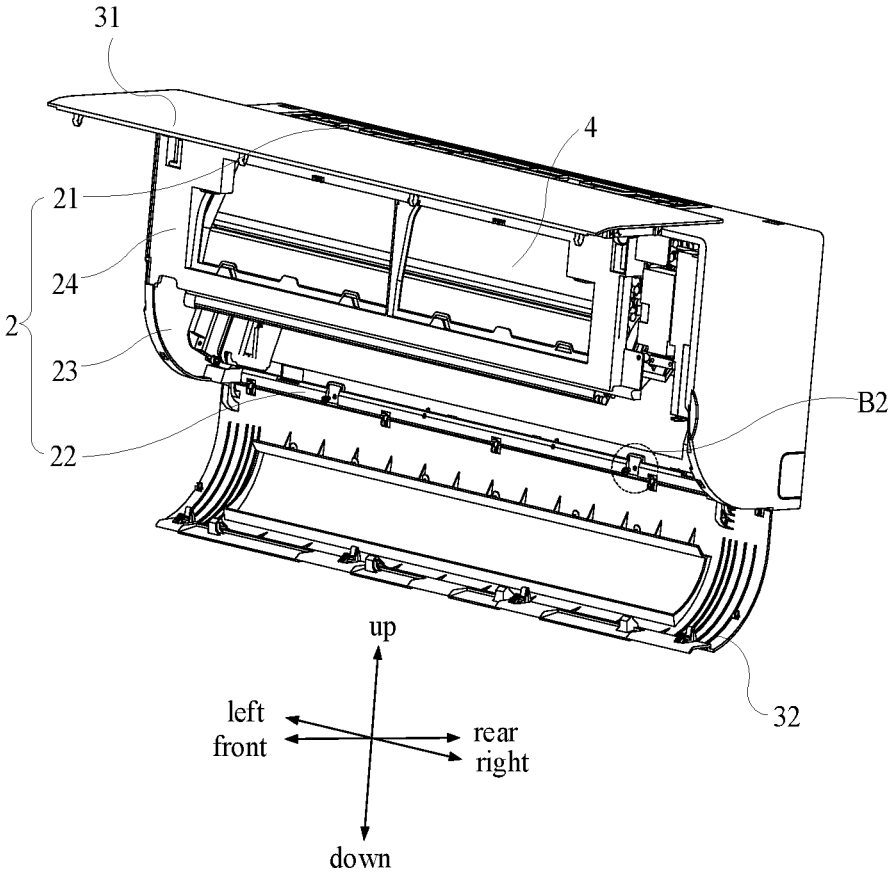
Figure 5C:
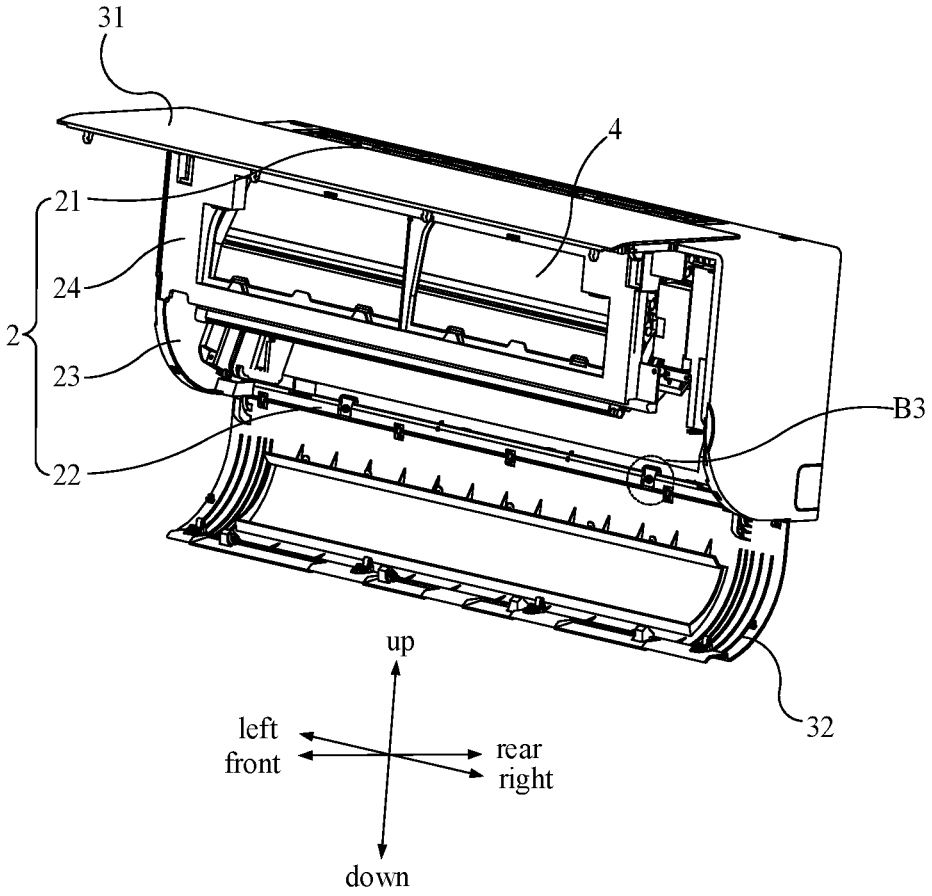
Figure 6A:
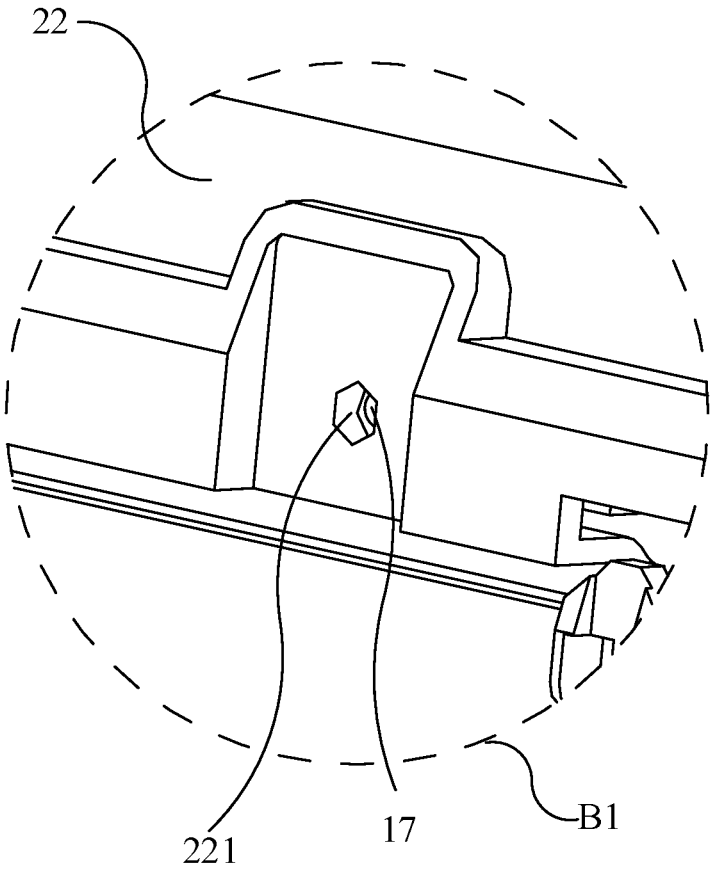
FIGS. 6A, 6B, and 6C are enlarged views of portion B1 in FIG. 5A, portion B2 in FIG. 5B, and portion B3 in FIG. 5C, respectively.
Figure 6B:
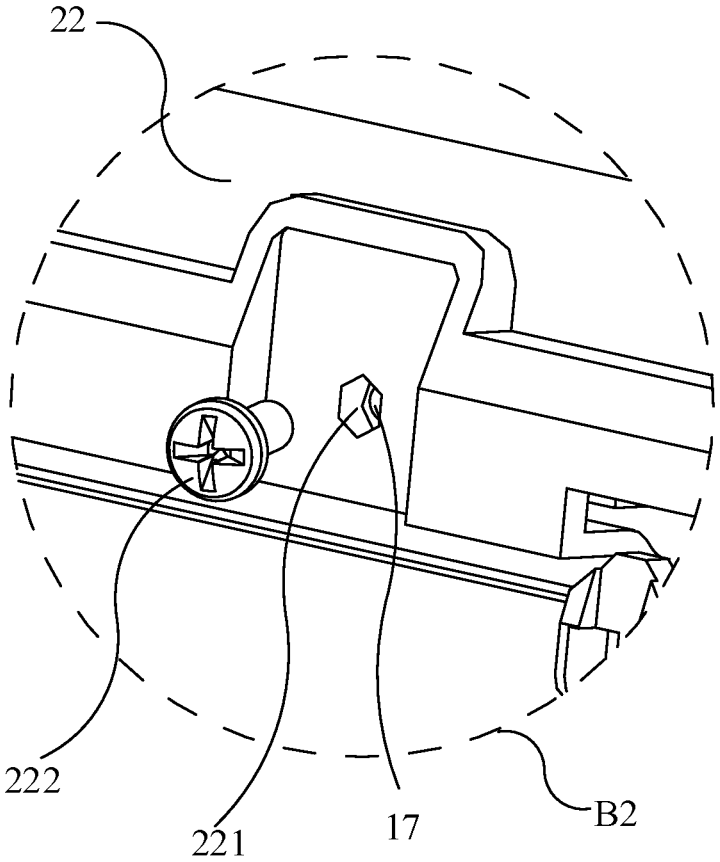
Figure 6C:
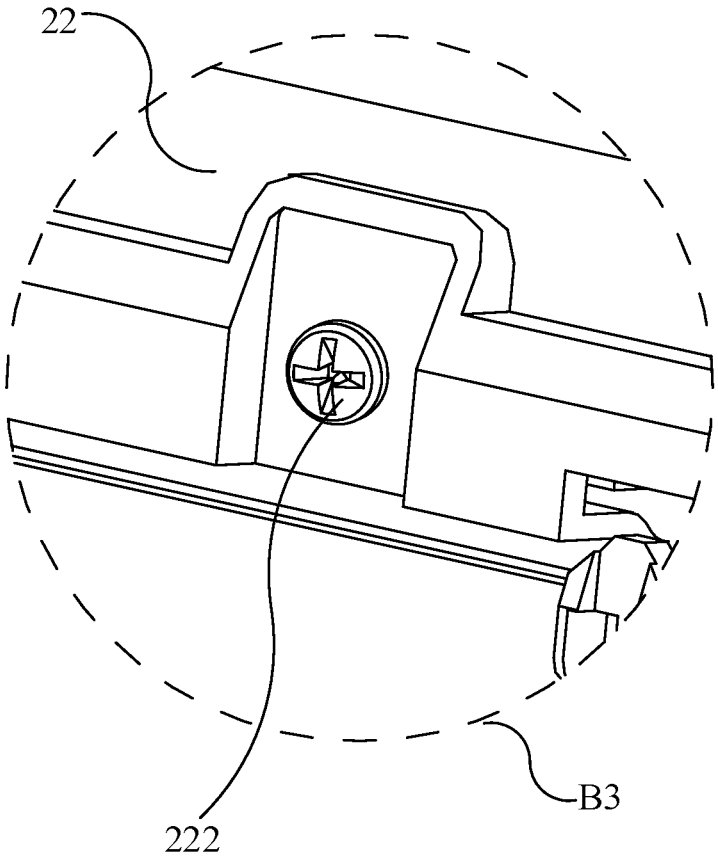

Referring to FIG. 2 and FIG. 3, in the present embodiment, a distance between one group of the plurality of fastening structures and a top surface of the upper support 21 is greater than a distance between another one of the plurality of fastening structures and the top surface of the upper support 21. For example, in the present embodiment, the upper end of the chassis 1 is provided with four fastening structures spaced along the left-right direction. The positions of the two fastening structures located in the middle are lower, and the positions of the fastening structures located at the left and right sides are higher. When multiple fastening structures are in different positions, they can limit the position of the upper support 21 in the up-down direction to a certain extent, so as to reduce the shaking of the face frame 2 in the up-down direction and improve the installation stability of the face frame 2.

Figure 7:
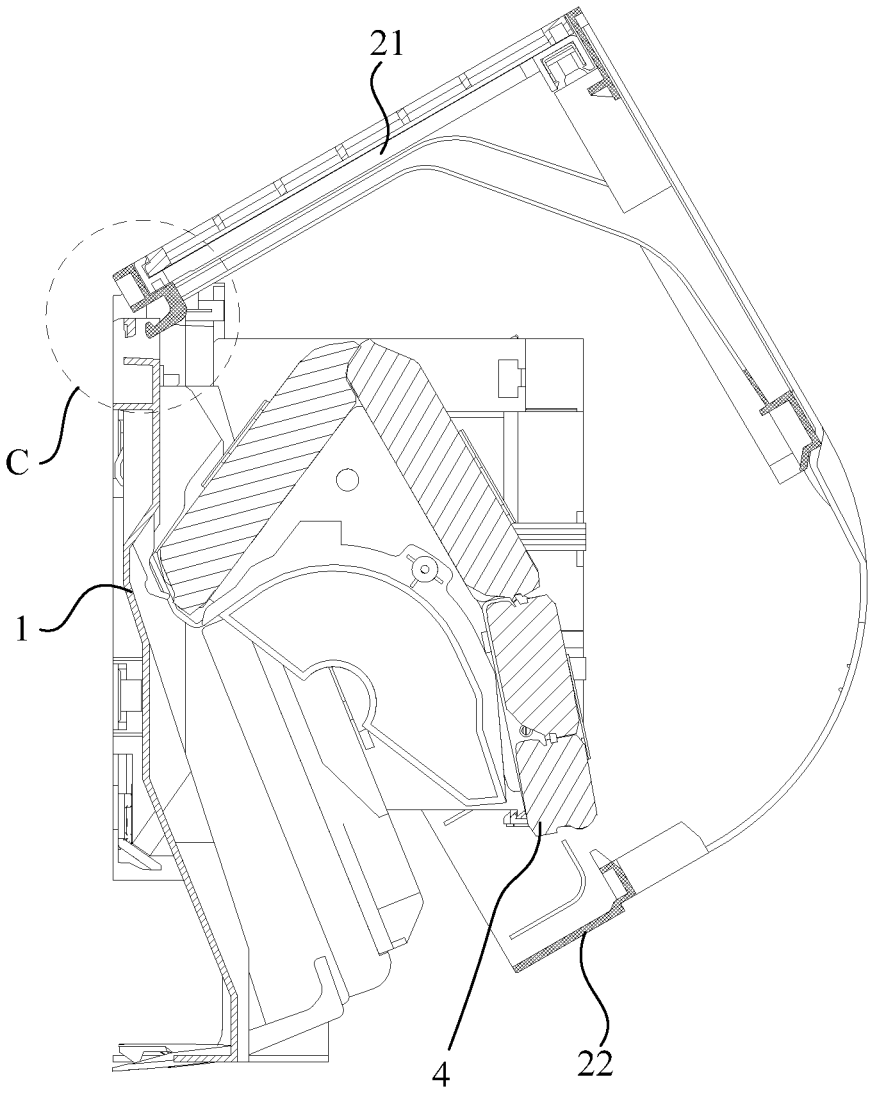
FIG. 7 is a schematic cross-sectional structural view of the face frame in FIG. 4 in a disassembled state.
Figure 8:
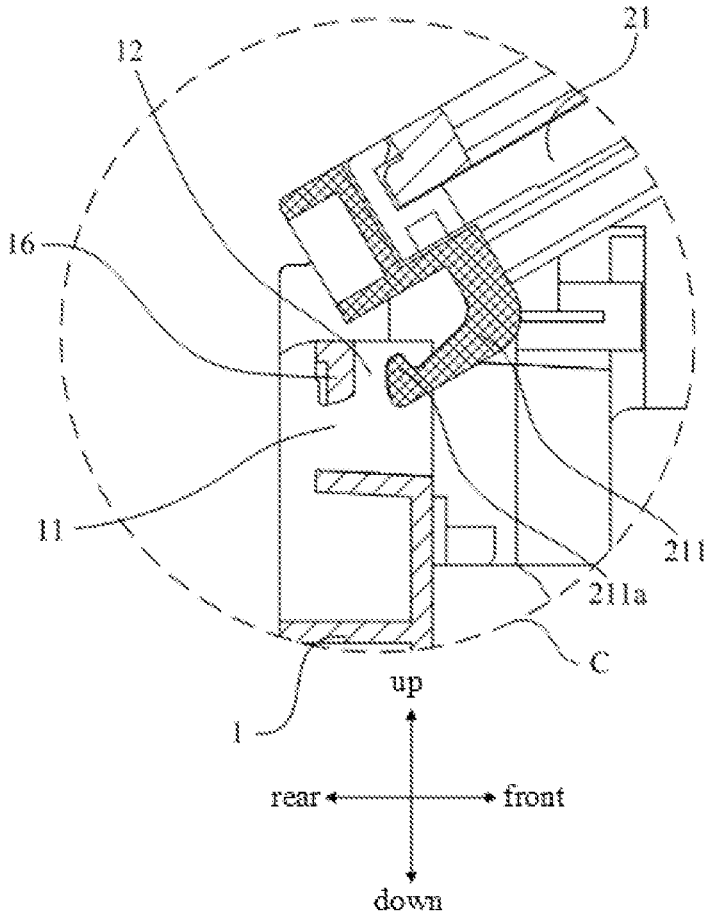
FIG. 8 is an enlarged view of portion C in FIG. 7.
Figure 9:
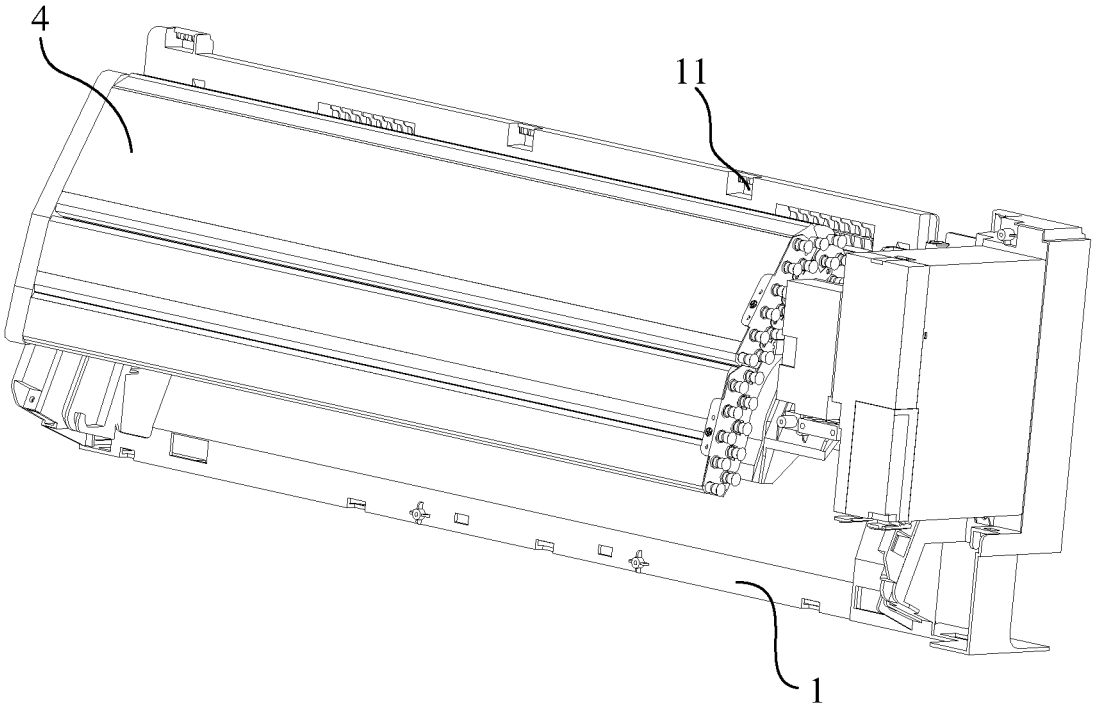
FIG. 9 is a schematic structural view of the air conditioner indoor unit when the face frame in FIG. 7 is completely removed.

Specifically, in the present embodiment, referring to FIG. 3, FIG. 7 and FIG. 8, the fastening structure includes a fastening hole 11 formed at a front wall surface of the upper end of the chassis 1. The fastening member includes an elastic arm 211 protruding downwards from a bottom surface of a rear end of the upper support 21 and extending backwards. A convex clasp 211*a* is provided at an upper side surface of a free end of the elastic arm 211, and when the face frame 2 is in an assembled state, the clasp 211*a* is located at a rear wall surface of the upper end of the chassis 1, so that the upper support 21 can be restricted in the front-rear direction. Specifically, the fastening hole 11 is provided through the front and rear, and an elastic clasp piece 16 formed of a thin-walled structure is provided above the fastening hole 11. When the face frame 2 is in the assembled state, the clasp 211*a* is fastened to the rear wall surface of the elastic clasp piece 16. When the face frame 2 needs to be disassembled, the elastic clasp piece 16 and the elastic arm 211 are elastically deformed with respect to each other, so that the clasp 211*a* can be disengaged. That is, when the face frame 2 is in the assembled state, the fastening member is fastened with the fastening structure to limit the face frame 2 in a front-rear direction, and when a lower end of the face frame 2 is rotated to a preset angle with respect to the upper end of the chassis 1, the fastening member is disengaged from the fastening structure.

Further, in order to prevent the elastic arm 211 from interfering with the fastening hole 11 when being disengaged, an avoidance recess 12 is provided above a front side of the fastening hole 11 for the elastic arm 211 to escape. When the face frame 2 is in an assembled state, an avoidance gap is formed between a lower side surface of the elastic arm 211 and a lower wall surface of the fastening hole 11 for the elastic arm 211 to escape. In this way, when the elastic arm 211 is disengaged, the elastic arm 211 can move downwards for a distance and then disengage the clasp 211*a*, thereby making the disengagement of the elastic arm 211 more labor-saving and simple.

Figure 10:
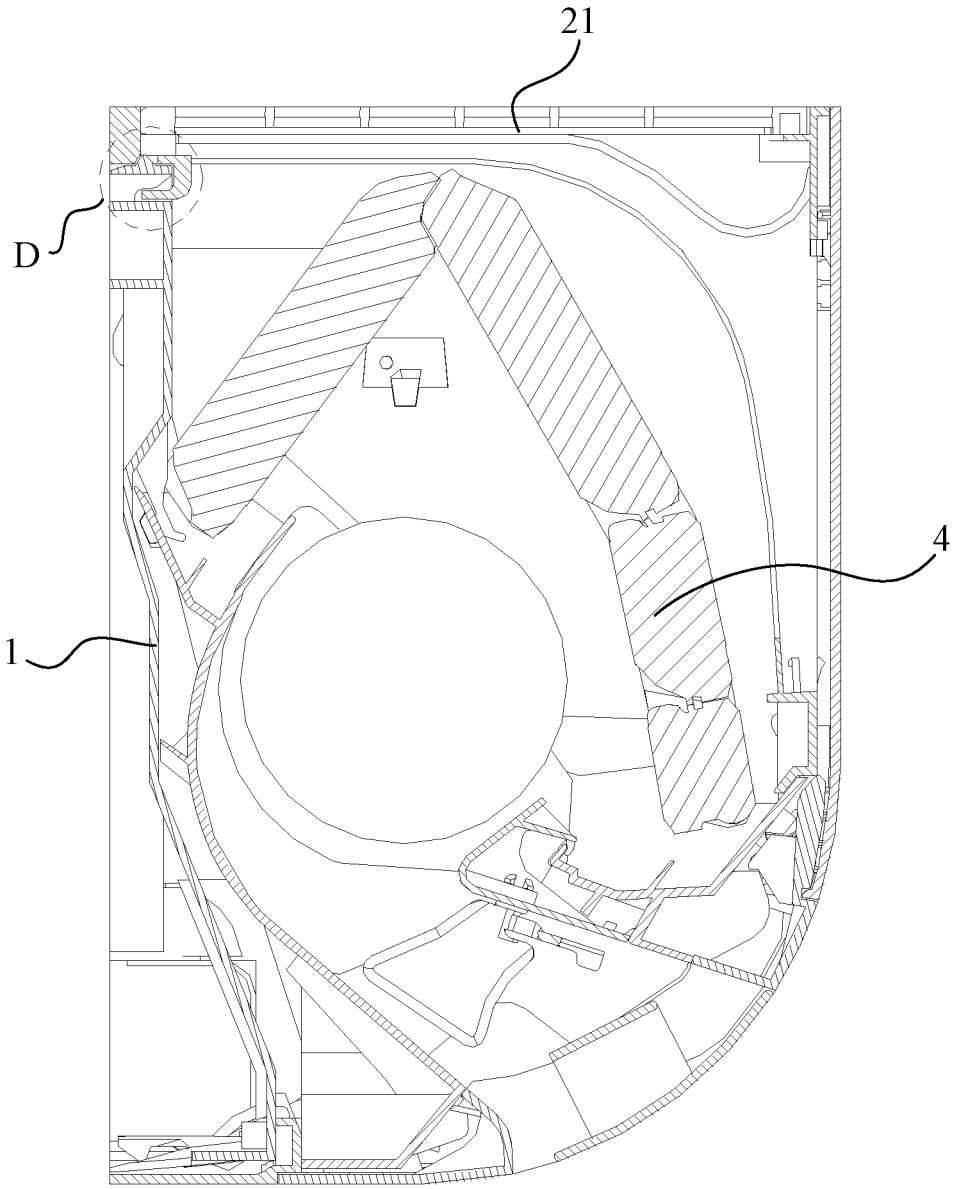
FIG. 10 is a schematic cross-sectional structure view of the air conditioner indoor unit in an assembled state according to another embodiment of the present disclosure.
Figure 11:
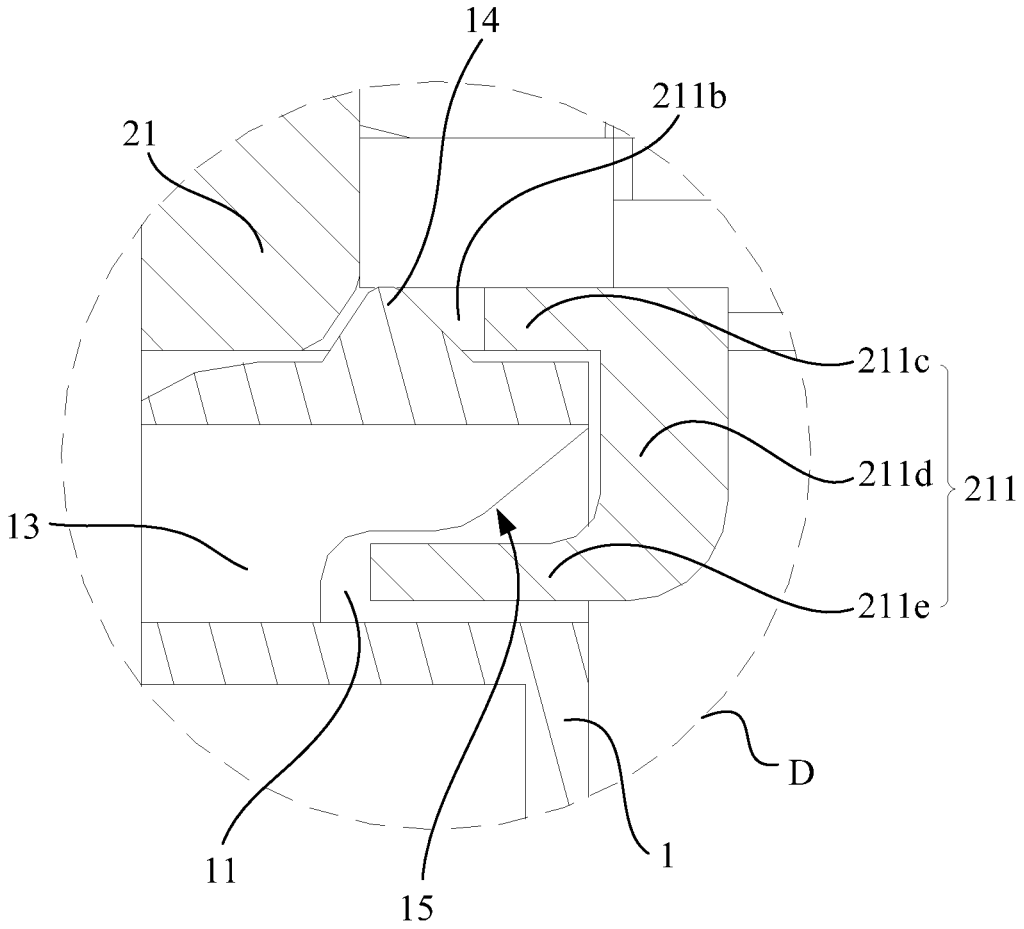
FIG. 11 is an enlarged view of portion D in FIG. 10.

The fastening member and the fastening structure can also have other shapes. FIG. 10 and FIG. 11 show another embodiment of the present disclosure. The main difference from the previous embodiment is that: a limiting protrusion 14 corresponding to the fastening structure is provided at a top surface of the chassis 1, and the fastening member is provided with a limiting hole 211*b* configured to receive the limiting protrusion 14. The limiting protrusion 14 and the limiting hole 211*b* can limit the position of the face frame 2 in the front-rear direction to a certain extent. Specifically, the fastening structure includes a fastening hole 11 formed at a front wall surface of the upper end of the chassis 1. The fastening member includes an elastic arm 211 protruding downwards from a bottom surface of a rear end of the upper support 21 and extending backwards. The elastic arm 211 includes a connection section 211*c*, a support section 211*d*, and an insertion section 211*e* which are connected with each other in sequence. The connection section 211*c* is connected with the upper support 21 and includes the limiting hole 211*b*, the support section 211*d* extends downwards from a front end of the connection section 211*c*, and the insertion section 211*e* extends backwards from a lower end of the support section 211*d*. When the face frame 2 is in an assembled state, the insertion section 211*e* is inserted into the fastening hole 11. The fastening hole 11 can play a certain role of limiting the elastic arm 211 in the up-down direction. It should be specifically noted that the upper wall surface of the fastening hole 11 is provided with a plurality of process holes arranged along the left-right direction, and ribs 13 are formed between any two adjacent process holes. The ribs 13 are mainly provided for consideration of the injection molding process. Further, as shown in FIG. 11, an entrance portion of a front end of the fastening hole 11 includes a guiding bevel 15 inclined upwards and forwards. The guiding bevel 15 has a guiding function for the insertion section 211*e* of the elastic arm 211 to enter and exit the fastening hole 11, so that the insertion section 211*e* can enter and exit the fastening hole 11 more conveniently.

Referring to FIGS. 5A-5C and 6A-6C, as for the connection and fixing manner of the lower frame 22, specifically, in the present embodiment, a plurality of through holes 221 are formed at a front side of the lower frame 22 in a left-right direction, and the lower end of the chassis 1 is provided with fixing holes 17 corresponding to the through holes 221. The air conditioner indoor unit further includes a plurality of fasteners 222 (such as, but not limited to, screws). Each fastener 222 passes through the corresponding through hole 221 and the corresponding fixing hole 17 to fix the face frame 2 and the chassis 1. In other embodiments, the lower frame 22 may be detachably fastened to the lower end of the chassis 1.

Referring to FIG. 1, FIG. 4 and FIGS. 5A-5C, in the present embodiment, specifically, the panel 3 includes an upper panel 31 and a lower panel 32 cooperated with the upper panel 31 to cover a front side of the face frame 2. An upper end of the upper panel 31 is pivotally connected to a front end of the upper support 21, and a lower end of the upper panel 31 is rotatable with respect to the upper support 21 to open the indoor unit. A lower end of the lower panel 32 is pivotally connected to the lower end of the chassis 1, and an upper end of the lower panel 32 is rotatable with respect to the chassis 1 to open the indoor unit. Compared to common air conditioner indoor unit that can only be opened upwards to remove the filter, the upper and lower panels 32 of the present air conditioner indoor unit can both be rotated to open the indoor unit so that the front side of the air outlet frame 5 is completely exposed, which is beneficial to the smooth sliding out of the air passage assembly and the convenience of maintenance of the air conditioner indoor unit. In addition, the upper panel 31 can be detachably and non-detachably connected to the upper support 21, and the lower panel 32 can be detachably and non-detachably connected to the lower end of the chassis 1. When the two are detachably connected, the upper panel 31 and/or the lower panel 32 may be removed before the face frame 2 is removed.

The present disclosure further provides an air conditioner. The air conditioner includes an air conditioner indoor unit consistent with the disclosure. For the specific structure of the air conditioner indoor unit, reference can be made to the above embodiments. Since all the technical solutions of all the above embodiments are adopted in the air conditioner, at least all the effects brought by the technical solutions of the above embodiments are not described herein.

The above are only some embodiments of the present disclosure, and thus do not limit the scope of the present disclosure. The equivalent structure or equivalent process transformations made by the present specification and the drawings are directly or indirectly applied to other related technical fields, and are included in the scope of the present disclosure.

What is claimed is:

1. An air conditioner indoor unit comprising:

a chassis extending along an up-down direction and including:

a plurality of fastening structures arranged at upper end of the chassis and spaced along a left-right direction; and a plurality of fixing holes formed at a lower end of the chassis;

a face frame including:

an upper support including a fastening member arranged at a rear end of the support, the fastening member being detachably fastened to the upper end of the chassis;

a lower frame detachably connected to the lower end of the chassis and including a plurality of through holes formed at a front side of the lower frame and spaced along a left-right direction, the through holes corresponding to the plurality of fixing holes; and two side connectors opposite to each other and connected between the upper support and the lower frame; and a fastener configured to pass through at least one of the through holes and at least one of the fixing holes to fix the face frame and the chassis.

2. The air conditioner indoor unit according to claim 1, wherein:

the plurality of fastening structures include a first group including one or more of the fastening structures and a second group including another one or more of the fastening structures; and a distance between the first group and a top surface of the upper support is greater than a distance between the second group and the top surface of the upper support.

3. The air conditioner indoor unit according to claim 1, wherein:

the fastening structures include a fastening hole formed at a front wall surface of the upper end of the chassis;

the fastening member includes an elastic arm protruding downwards from a bottom surface of the rear end of the upper support and extending backwards, the elastic arm including a clasp provided at an upper side surface of a free end of the elastic arm; and the fastening member is configured to:

be fastened with the fastening structure to limit the face frame in a front-rear direction when the face frame is in an assembled state, and disengage from the fastening structure when a lower end of the face frame rotates with respect to the upper end of the chassis to a preset degree.

4. The air conditioner indoor unit according to claim 3, wherein:

an avoidance recess is provided at an upper-front side of the fastening hole configured to allow the elastic arm to escape, and when the face frame is in the assembled state, an avoidance gap is formed between a lower side surface of the elastic arm and a lower wall surface of the fastening hole for the elastic arm to escape.

5. The air conditioner indoor unit according to claim 1, wherein:

the chassis further includes a limiting protrusion provided at a portion of a top surface of the chassis that corresponds to the fastening structure; and the fastening member includes a limiting hole configured to receive the limiting protrusion.

6. The air conditioner indoor unit according to claim 5, wherein:

the fastening structures include a fastening hole formed at a front wall surface of the upper end of the chassis; and the fastening member includes an elastic arm protruding downwards from a bottom surface of the rear end of the upper support and extending backwards, the elastic arm including:

a connection section connected with the upper support and including the limiting hole;

a support section extending downwards from a front end of the connection section; and an insertion section extending backwards from a lower end of the support section, and configured to be inserted in the fastening hole when the face frame is in an assembled state.

7. The air conditioner indoor unit according to claim 6, wherein a guiding bevel is provided at an entrance portion of a front end of the fastening hole, the guiding bevel being inclined upwards and forwards.

8. The air conditioner indoor unit according to claim 1, wherein the lower frame is detachably fastened to the lower end of the chassis.

9. The air conditioner indoor unit according to claim 1, further comprising:

a panel covering a front side of the face frame.

10. The air conditioner indoor unit according to claim 9, wherein the panel includes:

an upper panel, an upper end of the upper panel being pivotally connected to a front end of the upper support, and a lower end of the upper panel being rotatable with respect to the upper support; and a lower panel configured to cooperate with the upper panel, a lower end of the lower panel being pivotally connected to the lower end of the chassis, and an upper end of the lower panel being rotatable with respect to the chassis.

11. The air conditioner indoor unit according to claim 1, further comprising:

a heat exchanger.

12. The air conditioner indoor unit according to claim 1, further comprising:

an air outlet frame.

13. An air conditioner comprising:

an indoor unit including:

a chassis extending along an up-down direction and including:

a plurality of fastening structures arranged at upper end of the chassis and spaced along a left-right direction; and a plurality of fixing holes formed at a lower end of the chassis;

a face frame including:

an upper support including a fastening member arranged at a rear end of the support, the fastening member being detachably fastened to the upper end of the chassis;

a lower frame detachably connected to the lower end of the chassis and including a plurality of through holes formed at a front side of the lower frame and spaced along a left-right direction, the through holes corresponding to the plurality of fixing holes; and two side connectors opposite to each other and connected between the upper support and the lower frame; and a fastener configured to pass through at least one of the through holes and at least one of the fixing holes to fix the face frame and the chassis.

14. An air conditioner indoor unit comprising:

a chassis extending along an up-down direction and including a plurality of fastening structures arranged at upper end of the chassis and spaced along a left-right direction;

a face frame including:

an upper support including a fastening member arranged at a rear end of the support, the fastening member being detachably fastened to the upper end of the chassis;

a lower frame detachably connected to a lower end of the chassis; and two side connectors opposite to each other and connected between the upper support and the lower frame; and a panel covering a front side of the face frame and including:

an upper panel, an upper end of the upper panel being pivotally connected to a front end of the upper support, and a lower end of the upper panel being rotatable with respect to the upper support; and a lower panel configured to cooperate with the upper panel, a lower end of the lower panel being pivotally connected to the lower end of the chassis, and an upper end of the lower panel being rotatable with respect to the chassis.

* * * * *